US005771727A

United States Patent [19]

Stinnertz et al.

[11] Patent Number: 5,771,727

[45] Date of Patent: Jun. 30, 1998

[54] PROCESS AND DEVICE FOR STRAIGHT-DRAWING LONG DRAWING MATERIAL IN MULTIPLE STEPS

[75] Inventors: Horst Stinnertz, Willich; Peter Kalkenings, Aachen; Karl Heinz Häusler, Korschenbroich, all of Germany

[73] Assignee: Mannesmann Aktiengesellschaft, Düsseldorf, Germany

[21] Appl. No.: 749,819

[22] Filed: Nov. 15, 1996

[30] Foreign Application Priority Data

Nov. 15, 1995 [DE] Germany ..... 195 44 383.7

[51] Int. Cl.[6] ..... B21C 1/20

[52] U.S. Cl. ..... 72/21.4; 72/291

[58] Field of Search ..... 72/290, 291, 282, 72/21.4

[56] References Cited

U.S. PATENT DOCUMENTS

| | | | |
|---|---|---|---|
| 3,138,243 | 6/1964 | Oakley | 72/290 |
| 3,690,133 | 9/1972 | Hilgers | 72/290 |
| 3,798,939 | 3/1974 | Mertens et al. | 72/288 |
| 4,119,254 | 10/1978 | Lorenz | 72/290 |
| 4,127,999 | 12/1978 | Lorenz | 72/290 |
| 4,662,203 | 5/1987 | Kanatani | 72/282 |
| 4,879,892 | 11/1989 | Paraskevas | 72/290 |

FOREIGN PATENT DOCUMENTS

| | | | |
|---|---|---|---|
| 2806380 | 8/1979 | Germany | 72/290 |

*Primary Examiner*—Daniel C. Crane

*Attorney, Agent, or Firm*—Cohen, Pontani, Lieberman, Pavane

[57] ABSTRACT

A process for drawing stretched metal workpieces, especially tubes, for the purpose of cross-sectional reduction in more than one drawing step using at least two sequential drawing aggregates. The aggregates grip the workpiece on the outer periphery, with two alternately-moved clamping carriages, which draw the workpiece continuously through respective drawing rings associated with the respective aggregates and arranged in respective drawing-ring holders. The drawing aggregates can be driven independently of one another in a power-regulated and/or moment-regulated manner. Furthermore, during the drawing process, a defined prestress force, which prevents deflection of the workpieces from a straight line, is maintained at all times in the section of the workpiece located between the drawing aggregates.

5 Claims, 1 Drawing Sheet

PROCESS AND DEVICE FOR STRAIGHT-DRAWING LONG DRAWING MATERIAL IN MULTIPLE STEPS

BACKGROUND OF THE INVENTION

1. Field of the Invention

The invention relates to a process and a device for drawing stretched metal workpieces, especially tubes, for the purpose of cross-section reduction in more than one drawing step by means of at least two sequential drawing aggregates, which grip the workpiece on its outer periphery, with two alternately-moved clamping carriages, which draw the workpiece continuously through respective drawing rings associated with each respective drawing aggregate and arranged in respective drawing-ring holders. The invention also relates to a process for threading the workpiece into the device.

2. Description of the Prior Art

In generic processes and devices, the danger exists that if the drawing aggregates arranged sequentially are not synchronized, then tensile or pressure forces will act upon the workpiece located between the drawing aggregates. In the best case, such forces deflect the workpiece out of the workpiece axis. In the worst case, they result in breakage of the workpiece. European reference EP 0182922 discloses a generic process and a device to implement the process, wherein the drawing material is deliberately deflected from its axis between drawing steps, at least intermittently, so that a buffer can be formed that prevents the drawing material from breaking. The disadvantage of this process is the high structural cost and the space required for the device to deflect the drawing material.

SUMMARY OF THE INVENTION

Starting from the described known solution and in order to avoid the disadvantages associated with it, the object of the present invention is to create a simple, space-saving drawing device that is economical to produce and operate, with which it is possible to thread the workpiece simply and to reduce the workpiece in multiple steps while maintaining tolerances.

Pursuant to this object and others which will become apparent hereafter, one aspect of the present invention resides in a process in which the drawing aggregates are driven independently of one another in a power-regulated and/or moment-regulated fashion so that during the drawing process a defined prestress force, which prevents deflection of the workpiece from a straight line, can be maintained at all times in the workpiece section located between the drawing aggregates. It is thus suggested according to the invention, in order to eliminate the disadvantages of the prior art, that looping be dispensed with, in order to obtain a compact, simple and economical drawing device.

In a further embodiment of the invention, the actual value of the drawing force is permanently measured and compared to a preset value stored in a computer. According to the invention, when the actual value exceeds or falls below the preset value, a signal is sent to the drive or drives of one or more drawing aggregates in order to adjust the drawing force to the preset value.

Preferably, as a tube is being drawn into a particular drawing aggregate, the drawing force is measured and sent to the computer as the preset value of a restraining and/or pulling force. In the computer, superimposing the acceleration moments and loss moments of the drawing aggregates and in dependence on the current drawing speed, a limiting moment curve is established, which is used to regulate the drive of the drawing aggregate or aggregates in question.

The limiting moment curve is meant to ensure that the tensile stress between two adjacent drawing aggregates is kept as low as possible, so that optimal use can be made of the ductility of the drawing material. The particular given drawing speed results from the drawing speed of the previous aggregate and the elongation of the drawing material in the current drawing aggregate. Because this elongation is subject to certain tolerances, it is necessary to avoid either an oversupply of drawing material or an impermissibly high pulling force between two adjacent drawing aggregates.

An oversupply of drawing material would make itself felt as a pressure force on the drawing-ring holder of the following machine. This pressure force on the drawing-ring holder would reduce the drawing force of the machine in question. On the other hand, in the event of an undersupply of drawing material, a pulling force arises between the first and the second machine or their drawing cars. Such an undersupply would make itself felt as the total increase in the tensile force between the two drawing machines and the drawing force at the drawing-ring holder. The speed regulation and torque regulation for the driving motors must therefore be designed so that low prestress is ensured at all times in the drawing material between adjacent drawing aggregates.

The present description of force actions relates to adjacent drawing machines, the drawing-ring holders of which are rigidly connected to the machine in the known manner. However, if one of the drawing-ring holders, preferably the drawing-ring holder of a second machine that follows a first machine, is movably regulated in dependence on the total force, then the force directions also change.

A device to implement the process according to the invention is therefore characterized by the fact that at least one drawing-ring holder of one drawing aggregate is equipped with a measurement device to permanently detect the drawing force. Furthermore, the drawing-ring holder or holders can be moved or clamped in the longitudinal direction of the workpiece in a power-regulated and/or moment-regulated fashion in dependence on the measurement value.

If an oversupply of drawing material develops between two sequential machines, the regulated movement of the drawing-ring holder in the drawing direction at a certain speed will increase the tensile force of the following machine. On the other hand, in the event of an undersupply of drawing material, a movement of the drawing-ring holder in the opposite direction will reduce the tensile force.

When a tube is drawn into a particular drawing aggregate, the drawing force is measured and established as the preset value of the holding and movement device for the drawing-ring holders in question. If the device for holding and moving the drawing-ring holder is regulated in a power-dependent manner, in such a way that the drawing-ring holder remains just in position, then any oversupply of drawing material will cause the drawing-ring holder to move in the drawing direction. If the measured total force is reduced due to the movement of the drawing-ring holder, then the speed of the driving motor of the following machine must be increased accordingly.

If the measured total force does not change as the result of such movement of the drawing-ring holder, then other reasons, such as drawing material tolerances or lubricant influences, are the cause of the increase in total force, which can be countered by increasing the holding force for the drawing-ring holder.

In practice, it is unavoidable for breakages to occasionally occur during drawing. These breaks can be directly registered by means of the permanent drawing-force measurement devices, resulting in all drawing devices being opened.

Advantageously, the measurement device consists of a load cell arranged bet ween the drawing-ring holder and the drawing ring.

To further ensure the proper flow of material, in another embodiment of the invention, in order to detect any undesired deflections of the drawing material from the drawing axis, optical sensors that are linked to the computer are provided between the drawing aggregates to regulate and/or shut off the drives. Light sensors of this type, which are located between two drawing aggregates in order to monitor the position of the drawing material, can also be used to additionally monitor tube breaks and control material oversupply between the aggregates.

In addition, the device according to the invention permits start-up times to be shortened. According to the prior art, an auxiliary device normally draws the front tip of the tube out in multiple steps, until the actual drawing device(s) is/are able to completely grip the tube with the clamping jaws of the first drawing car and the full drawing force can be applied to the tube. By its nature, this process is associated with time losses. The device according to the invention permits a process that is characterized by the following sequence of work steps:

a. The movable drawing-ring holder and the clamping carriages of the drawing aggregate that face the drawing ring are moved into the position where they are least distant from one another.

b. The beginning of the workpiece is inserted into the drawing ring and held in place by an auxiliary device arranged in front of the drawing aggregate.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

c. The drawing-ring holder is moved back, with the drawing ring, against the drawing direction, as a result of which the length of the drawn-in workpiece is lengthened.

d. After the auxiliary device is opened, the drawing-ring holder and drawing ring are moved back, with the drawn-in workpiece, in the drawing direction, inserted into the clamping jaws of the drawing carriage of the drawing aggregate, and clamped there.

The drawing-in process thus begins when the drawing-ring holder and the forward drawing carriage have their shortest possible distance from one another. If, when the tube is drawn in by the auxiliary device, the drawing-ring holder is simultaneously moved back against the drawing direction under drawing force, then the length of the drawn-in tube will be lengthened accordingly. In this way, the drawing-in operation can be completed with only a single drawing-in and thus substantially shortened.

Preferably, the two drawing carriages of a drawing aggregate alternately transport the gripped workpiece to the next drawing ring in the drawing direction, where the drawing-in process is repeated in Steps a to d.

BRIEF DESCRIPTION OF THE DRAWINGS

The single drawing shows the arrangement of two drawing aggregates pursuant to the present invention.

DETAILED DESCRIPTION OF THE PREFERRED EMBODIMENTS

Figure 1B:
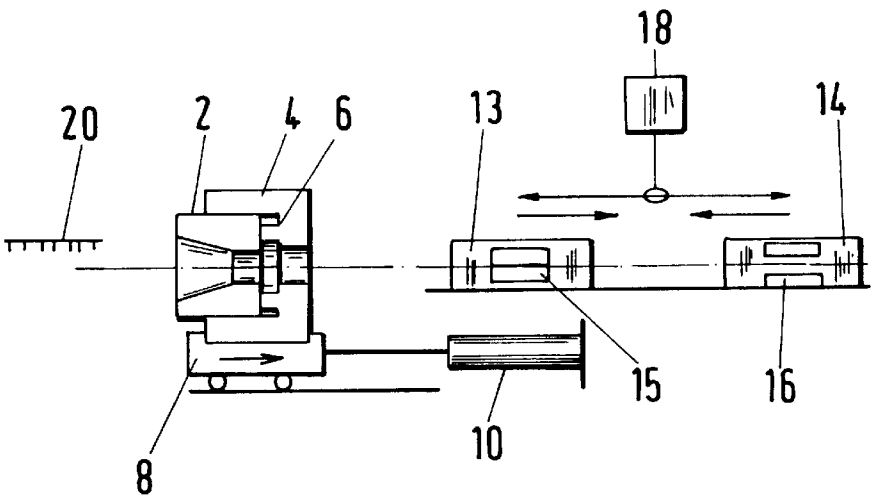
Figure 1A:
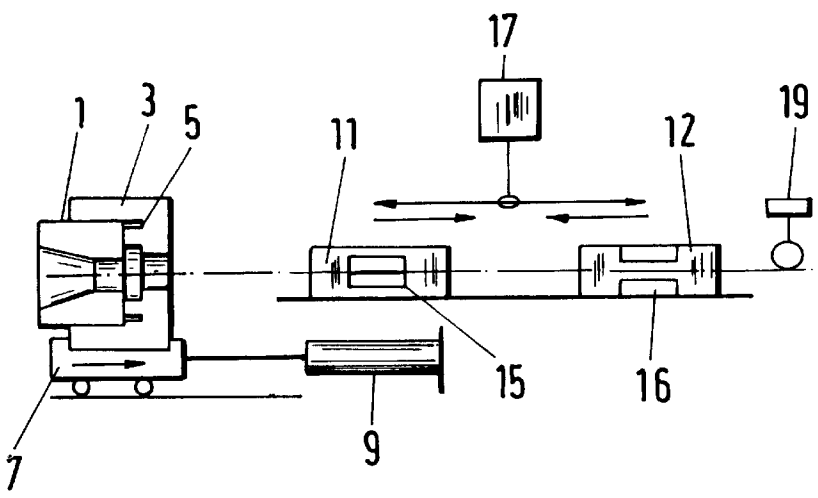

The drawing rings (1, 2) rest via load cells (5, 6) against the drawing-ring holders (3, 4). The drawing-ring holders (3, 4) are mounted in a movement device (7, 8), which rests against a hydraulic cylinder (9, 10). The drawing material is drawn by means of two alternately-operating drawing carriages (11, 12) and (13, 14). Clamping jaws (15, 16) are closed when moving in the drawing direction and opened when returning against the drawing direction. The drawing force and alternating carriage movements are produced by driving motors (17, 18). At the start of a work cycle, the drawing carriages (11, 13) are located at their forward dead centers. The drawing-ring holders (3, 4) are located at their rear dead centers, i.e., close in front of the drawing carriages (11, 13). The front end of drawing material, which is provided with a projection, is slipped through the drawing ring (1) until the projection can be encompassed by an auxiliary drawing device located on the plane of the drawing carriage.

Preferably, the drawing-ring holder (3) and the carriage (11) move out of their dead center positions in opposite directions and thus produce a drawn tube projection in keeping with the total of the two distances travelled. The auxiliary drawing clamp is opened and the drawing-ring holder (3) moves in the drawing direction to its initial dead center. The holder thereby transports the drawing material so far forward that it can be gripped by the clamping jaws (15) of the carriage (11). The carriages (11, 13) then alternately draw the drawing material up to the drawing ring (2). The drawing-in process as described for aggregate (A) is then repeated in the second drawing aggregate (B). To determine the drawing force in the second aggregate, without being influenced by the first aggregate, the clamping jaws (15, 16) in the carriages (11, 12) are opened and the cylinder (9) is made pressure-free. The measured drawing force serves as a control variable for the torque of the second drawing aggregate. The load cell (6) determines the drawing force and communicates this to the regulating mechanism of the hydraulic cylinder (10), which then exercises an appropriate holding force on the drawing-ring holder (4).

Taking into account the dynamics and kinetics of the carriage drive, a computer program sets the mechanical losses and the measured drawing force of the carriage drive torque in such a way that the ductility limit of the drawing material is not reached by a certain amount and, secondly, that the drawing material is subjected to a low defined tensile stress between the two drawing aggregates. If the required drawing force increases during drawing, the drawing-ring holder is pushed back against the cylinder (10). If, as a result, the total force on the matrix falls to the order of magnitude registered during drawing-in, then the drawing speed in the second aggregate is not sufficient and the speed of the motor (18) must be increased. If the backward movement of the drawing-ring holder (3) does not result in a corresponding change in the increased total force, this means that the drawing conditions are being altered by tolerances or lubricant influences; in this case, the torque characteristic must be corrected accordingly. If the drawing material has left the drawing ring (1), the drawing force there will collapse, after which speed regulation is carried out for the second drawing aggregate independently of the first. In the event of a tube break in one of the two drawing aggregates, the drawing force in one of the two drawing rings (1, 2) falls to 0 and the following command issues: "Open all drawing jaws, stop, driving motors." The drawing material can then be furnished with a new projection in front of either the first or the second drawing aggregate. This sequence of functions is applied to other downstream drawing aggregates in the same manner. A scanning roll (19) on the drawing material permanently measures the actual drawing speed. If the measured speed is lower than the speed determined from the drawing carriages, the clamping jaws will slip. The values of the scanning roll are then definitive for the purpose of speed regulation. As needed, the speed difference can be used to break off the drawing process for the purpose of checking the clamping conditions. A light sensor (20) controls the axis position of the drawing material. If there is an oversupply of drawing material that can no longer be controlled by the regulating means, the drawing material will attempt to slide out or even to buckle out. This is registered and used to regulate or shut down the aggregates.

The invention is not limited by the embodiments described above which are presented as examples only but can be modified in various ways within the scope of protection defined by the appended patent claims.

We claim:

1. A process for drawing a stretched metal workpiece for cross-sectional reduction in more than one drawing step with at least two sequential drawing aggregates, comprising the steps of: gripping an outer periphery of the workpiece in each of the aggregates with two alternately-moving clamping carriages for continuously drawing the workpiece through respective drawing rings arranged in drawing-ring holders of respective ones of the aggregates; driving the aggregates independently of one another by selectively moving and clamping the drawing-ring holders in a longitudinal direction of the workpiece in at least one of a power-regulated and moment-regulated manner for maintaining a defined prestress force that prevents deflection of the workpiece from a straight line during drawing; and permanently measuring an actual value of drawing force and comparing the actual value to a preset value stored in a computer, and, when the actual value is not equal to the set value, sending a signal to a drive of at least one of the drawing aggregates to adjust the drawing force to the preset value.

2. A process for drawing a stretched metal workpiece as defined in claim 1, wherein the measuring step includes measuring the drawing force during drawing-in of a tube into a particular drawing aggregate, and sending the measured drawing force as a preset value of at least one of a restraining and pulling force to the computer, establishing a limit moment curve by superimposing the preset valve with acceleration moments and loss moments of the drawing aggregates and in dependence on the current drawing speed, and regulating the drive of the drawing aggregate based upon the curve.

3. A device for drawing a stretched metal workpiece for cross-sectional reduction in more than one drawing step, comprising: at least two sequential drawing aggregates, each of the aggregates including drawing rings held in movable drawing holders, and two alternately-movable clamping carriages operative to grip an outer periphery of the workpiece and draw the workpiece through the drawing rings; measurement means for permanently measuring a drawing force value, the measurement means being mounted on one of the drawing ring holders; and means for selectively moving and clamping the drawing ring holders in a longitudinal direction of the workpiece in at least one of a power-regulated and a moment-regulated manner in dependence on the measured value of the drawing force.

4. A device for drawing a stretched metal workpiece as defined in claim 3, wherein the the measurement means includes a load cell operatively arranged between the drawing-ring holder and the drawing ring.

5. A device for drawing a stretched metal workpiece as defined in claim 4, and further comprising means for driving the carriages, optical sensors provided between the drawing aggregates so as to detect an unwanted deflection of the workpiece from the drawing axis, and a computer operatively linked to the optical sensors and the driving means for selectively regulating and shutting down the driving means.

* * * * *